US009903068B2

(12) United States Patent
Murari

(10) Patent No.: US 9,903,068 B2
(45) Date of Patent: Feb. 27, 2018

(54) CARBON FIBER FABRIC CLEANING AND FINISHING

(71) Applicant: Shobha Murari, Greenville, SC (US)

(72) Inventor: Shobha Murari, Greenville, SC (US)

( * ) Notice: Subject to any disclaimer, the term of this patent is extended or adjusted under 35 U.S.C. 154(b) by 404 days.

(21) Appl. No.: 14/707,233

(22) Filed: May 8, 2015

(65) Prior Publication Data

US 2016/0326691 A1 Nov. 10, 2016

(51) Int. Cl.

| | |
|---|---|
| ***D06M 15/00*** | (2006.01) |
| ***D06M 15/55*** | (2006.01) |
| ***D06L 1/14*** | (2006.01) |
| ***D06M 11/50*** | (2006.01) |
| ***D06M 13/513*** | (2006.01) |
| ***D06M 16/00*** | (2006.01) |
| *D06M 101/40* | (2006.01) |

(52) U.S. Cl.

CPC ..... *D06M 15/55* (2013.01); *D06L 1/14* (2013.01); *D06M 11/50* (2013.01); *D06M 13/513* (2013.01); *D06M 13/5135* (2013.01); *D06M 16/003* (2013.01); *D06M 2101/40* (2013.01); *D06M 2200/35* (2013.01); *D06M 2400/01* (2013.01)

(58) Field of Classification Search

CPC ..... D06M 16/00; D06M 15/00

See application file for complete search history.

(56) References Cited

U.S. PATENT DOCUMENTS

| | | | | |
|---|---|---|---|---|
| 5,752,981 | A | 5/1998 | Fornelli | |
| 5,863,298 | A | 1/1999 | Fulton et al. | |
| 6,638,883 | B2 | 10/2003 | Gaffney et al. | |
| 2010/0029538 | A1 * | 2/2010 | Auterinen ..... | D06L 1/14 510/305 |
| 2014/0206248 | A1 | 7/2014 | Vito | |

* cited by examiner

*Primary Examiner* — Andrew Piziali

(74) *Attorney, Agent, or Firm* — Southeast IP Group, LLC; Thomas L. Moses

(57) ABSTRACT

A process to clean carbon fiber fabric of a pre-applied sizing, while simultaneously activating or preparing the fabric to receive a polymer resin is described. The cleaning process and chemistry combines an enzymatic cleaning solution with an oxidizing agent. The enzymatic solution strips the fibers of lubricants, surfactants, and other chemicals of the sizing which might otherwise interfere with interfacial properties and bonding of the fabric to the matrix resin. The inclusion of an oxidizing agent concurrently adds hydroxyl groups to the surface of the fabric allowing for the grafting of organic copolymers to the surface of the fabric, the copolymer being chosen based upon the desired polymer resin. This process provides a customized finished carbon fiber fabric to bond to a specific polymer resin, without interference resulting from an inadequate fiber sizing chemistry. In this way, a customizable finished fabric may be manufactured.

11 Claims, No Drawings

CARBON FIBER FABRIC CLEANING AND FINISHING

BACKGROUND OF THE INVENTION

Modern production methods for producing woven fabrics with looms often require treatment of the fibers or yarns prior to weaving. This process, wherein the yarns are coated with material known as "size", is used to strengthen the yarns and improve their resistance to abrasion, thereby allowing them to withstand the stress of the weaving process. A yarn sizing is a mixture of various chemicals, typically diluted in water, that are used to coat yarn fibers. Most yarn producers tend to develop their own sizing and apply it to the fiber to best suit the needs of the targeted application. In many instances, the sizing can often be used as a "signature" to differentiate the fibers offered by one producer from the fibers offered by another.

Typically, size is applied by drawing the yarns through a mixture of water and a sizing material soluble in water such as starch or polyvinyl alcohol. The yarn is thereby wetted and coated with the size material. Typically, the yarn is then subjected to a drying or heating process to remove the water, thus leaving a yarn coated with the size material for weaving.

In composite production, one of the main functions of a sizing is to form at least a temporary—and often a permanent—interface between the fiber surface and the matrix, or resin solvent. Carbon fiber composites, or carbon fiber-reinforced polymers, are commonly used wherever high strength-to-weight ratio and rigidity are required. The binding polymer is often a thermoset resin such as epoxy, but other thermoset or thermoplastic polymers, such as polyester, vinyl ester or nylon, are sometimes used. The composite may contain other fibers, such as aramid or glass fibers, as well as carbon fiber. The properties of the final carbon fiber composite product can also be affected by the type of additives introduced to the binding matrix resin.

Interfacial adhesion between the carbon fiber and the matrix resin is critical for the successful production of an end product composite; and for every matrix resin, a different sizing chemistry is required. In general, the adhesive property of the carbon fiber to the matrix resin changes depending on the surface treating agent used for the carbon fiber. Therefore, it is preferable to use a sizing agent which can adhere to the fiber enough to strengthen an adhesive property of the fiber to a matrix resin. For instance, in a case using an epoxy resin as a matrix resin, it is preferred to use an epoxy type sizing agent for the carbon fiber to improve the adhesive property against the epoxy resin. Because most carbon fiber, historically, has been used with epoxy matrices, sizing is predominantly epoxy-based and low in molecular weight to encourage fiber pliability and spreadability.

In terms of composite properties, it would ideal be to have one sizing (one finished reinforcement) for each matrix. However, a sizing formulation that is compatible with one thermoset or thermoplastic resin is unlikely to be compatible with another. Although carbon fiber producers increasingly use a sizing appropriate to the customer's end use, for obvious practical reasons however, producers typically offer one sizing, or fiber, that will work adequately for a number of matrices in order to minimize the number of stock-keeping units. Unfortunately, consolidating the numbers and types of sizings results in a compromise in quality. For example, high-temperature composites can suffer from poor oxidative stability with sizings not formulated to match the requirements of specific matrix resin properties.

The conflicting impacts of sizing chemicals on the production and processing of the fiber, versus the quality and feasibility of the final composite, poses a major challenge to sizing development. Some sizing chemicals provide desirable properties for the former while being detrimental to the latter, often by affecting the interfacial properties. Very often lubricants and surfactants are the detrimental cause. For example, a lubricant aids weaving, a film former aids integrity and compatibility, and a cross-linking chemical may boost mechanical properties. When formulated into a sizing recipe, however, this mix of ingredients becomes difficult to stabilize over time or when submitted to shear forces. These conflicting results create yet another area where compromises in quality are often made.

Furthermore, chemical suppliers often sell polymeric dispersions that may result in undesired effects. For example, the polymeric nature might be appropriate and correct for the end-use resin; however, the surfactant, biocide or pH modifier used in the dispersion may not be compatible.

Sizing chemistry of carbon fibers contributes to the mechanical properties such as impact resistance, tensile strength, and fatigue resistance, as well as other material and chemical properties such as corrosion, hydrolysis, and heat and oil resistance of the composite part. The final color, surface aesthetics, odor profile, and many additional properties of the component part are also affected by the choice of sizing. One sizing cannot meet all requirements for the performance of a carbon composite.

Currently, processes have been developed to remove yarn sizes and apply optimum finish chemistries on quartz, fiberglass, aramid and thermoplastic fabrics; and, these processes are being used successfully in different composite resins for aerospace, filtration, electrical, construction, insulation and recreation industries. However, in the carbon composite industry, a process has not yet been developed to remove the yarn size and apply a finish chemistry optimum for the resin system with which the carbon composite is being made. Therefore, it would be very advantageous to provide a process to remove carbon yarn sizing and apply optimum finish chemistry for each composite resin system.

BRIEF SUMMARY OF THE INVENTION

In the case of composites or laminates formed from fiber strands woven into fabrics, in addition to providing good wet-through and good wet-out properties of the strands, it is desirable that the coating on the surface of the fibers strands protect the fibers from abrasion during processing, provide for good weavability (particularly on air jet looms), and be compatible with the polymeric matrix material into which the fiber strands are incorporated. The yarn sizing has many functions, and thus is often a very complex blend of ingredients. Yarn sizing formulations generally are composed of one or several polymeric components in dissolved, emulsified or dispersed form: a coupling agent, a lubricant (in dissolved, emulsified or dispersed form) and a range of additives such as surfactants, plasticizers, anti-static agents, adhesion promoters, anti-foams, rheology modifiers, and the like. This mixture is typically applied to the fiber in a rather dilute, aqueous form with solids content between 5 and 15%. However, many sizing components are not compatible with the polymeric matrix materials and can adversely affect adhesion between the carbon fibers and the polymeric matrix material. As a result, these incompatible materials should preferably be removed from the fabric prior to impregnation with the polymeric matrix material.

When obtained from the same supplier, carbon fiber is typically supplied with a single type of sizing applied to the fibers; meaning, regardless of the polymer resin or end use composite, the carbon fiber sizing will be the same. The sizing may vary from one supplier to another, thus differentiating one supplier's product from its competitor; however, the sizing of each supplier will not change regardless of the carbon fiber end use. As previously discussed, there is not a "one size fits all" sizing in the composite industry. With the continued advancements in composites, it has become clear that the sizing chemistry must be chosen specifically for the polymer resin that is to be grafted to the fabric. However, this procedure is not practical or feasible in the marketplace; therefore, to date, the best method is to devise a way to clean the fabric of the pre-supplied sizing, and finish the fabric in a way that is compatible with the final composite. In this way, the sizing can be utilized during the weaving process; yet, the sizing chemistry becomes irrelevant. Furthermore, to improve adhesion between the degreased or de-oiled fabric and the polymeric resin, a finishing size, typically a silane coupling agent and water, is applied to the fabric to re-coat the fibers in yet another processing step commonly called "finishing".

This invention relates generally to a method of carbon fiber fabric cleaning and finishing for reinforcing composites and, more specifically, a process and chemistry which will remove yarn sizing of carbon woven fabric, and apply an optimum finish as needed for different resin matrix used in the composite industry.

In another aspect, the present invention is a process for finishing carbon fiber fabrics comprising the steps of saturating the fabric in an enzymatic and oxidizing solution to remove processing aids and any surface contaminants, activating and preparing the fabric to take on a polymer finish that is compatible with a resin specific for end-use composites, and applying a selected organic polymer to the surface thereby finishing the fabric for its intended use.

In yet another aspect, this invention provides a method for creating a customizable carbon fabric for specific end-use composites by attaching a functional group compatible to specific resins dependent upon end use.

DETAILED DESCRIPTION OF THE INVENTION

Adhesion between matrix resin and carbon fiber is crucial in a reinforced composite. During the manufacture of carbon fiber, surface treatment is performed to enhance this adhesion. Producers use different treatments, but a common method involves pulling the fiber through an electrochemical or electrolytic bath that contains solutions, such as sodium hypochlorite or nitric acid. These materials etch or roughen the surface of each filament, which increases the surface area available for interfacial fiber/matrix bonding and adds reactive chemical groups, such as carboxylic acids. Next, a sizing is applied. At 0.5 to 5 percent of the weight of the carbon fiber, sizing protects the carbon fiber during handling and processing (e.g., weaving) into intermediate forms, such as dry fabric and prepreg. Sizing also holds filaments together in individual tows to reduce fuzz, improve processability and increase interfacial shear strength between the fiber and matrix resin.

Typically in the carbon fiber composite industry, there is no finishing process for carbon fiber fabric. Instead, it is the sizing applied to the carbon fibers that aids in the bonding of the fabric to the matrix resin; in other words, the sizing itself serves as the finishing. With the advancements in matrix resins now in demand for end-use applications, the current sizing chemistries are proving to be insufficient. Rather, it would be preferable to finish carbon fiber fabric in a way that is compatible with a particular customer's resin characteristics, as well as specific properties desired in the composite.

The present invention provides an efficient way to clean carbon fiber fabric of a pre-applied sizing, while simultaneously activating or preparing the fabric to receive a polymer resin. The cleaning process and chemistry of the present invention combines an enzymatic cleaning solution further including an oxidizing agent. The enzymatic solution strips the fibers of lubricants, surfactants, and other chemicals of the sizing which might otherwise interfere with interfacial properties and bonding of the fabric to the matrix resin. The inclusion of an oxidizing agent concurrently adds hydroxyl groups to the surface of the fabric. The addition of these hydroxyl groups allow for the grafting of organic copolymers to the surface of the fabric, the copolymer being chosen based upon the desired polymer resin to be added in a later step.

Cleaning Process

In one preferred example, the scouring agent (or cleaning solution) contains an enzymatic agent, referred to herein as "Enzyme A", and hydrogen peroxide. Enzyme A is a blend of cellulase and lipase in a phosphated alcohol surfactant. The cellulase and lipase are present in a preferred range of about 0.1 to 10% by volume, with phosphated alcohol in a preferred range of about 0.05 to 5% by volume, all mixed together in aqueous phase at room temperature. The preferred ratio range of peroxide to Enzyme A is about 2:1 to 5:2 by volume. The peroxide-enzyme mix is preferably at a concentration of about 2-15% by volume mixed with water, the percentage being chosen based on the strength and weight of the fabric. A stronger or heavier fabric may necessitate a higher percentage of peroxide-enzyme mix. A surfactant, such as tergitol, may be added at a preferred concentration of about 0.01-0.5% by volume to maintain dispersion and keep the mix in solution. Preferred surfactants or lubricants are the mono- or diesters of a fatty acid or oil reacted with polyethylene glycol, having hydrophilic and lipophilic areas. Enzyme A serves to break down the fatty acids esters and lubricants on the yarn, while the hydrogen peroxide oxidizes the carbon fiber fabric, adding hydroxyl groups to the fabric surface. In an alternative embodiment, plasma may be used in conjunction with oxygen, both serving the same purpose to clean the fibers of the sizing and oxidize the surface of the fabric.

While the chemicals comprising Enzyme A are preferred for the present invention, it is to be noted that any desired combination of specific enzymes may be substituted in the enzymatic component of the scouring agent, and certain enzymes may be preferred over others dependent upon the chemistry of the sizing that is to be removed. Any person skilled in the art is aware of enzymes available for use as well as their corresponding enzymatic function(s). Additionally, the enzymatic cleanser of the present invention is defined in terms of use on carbon fiber fabric-to strip the specific sizing on the carbon fabric. However, it is contemplated that this cleaning process and chemistry may be applied to other types of fabrics as well, such as quartz or fiberglass; and, adjustments to the cleaning chemistry may be made as needed for these different types of fabric.

In a preferred process, the fabric may be passed dipped, sprayed, or rolled in a bath containing the solution, after which the fabric is removed and squeezed to remove any excess solution. This process can be performed at room temperature and may be repeated preferably 3-4 times for at least 2-3 minutes. The dip and squeeze process may be performed stationary, such as in a jig, or may be a continuous process, such as in a range; other suitable processes may be used as well. After the fabric has undergone a dip and squeeze process, the fabric is dried preferably at 200-315 degrees F. This drying may be performed in a convection oven for anywhere from 30 seconds to 5 minutes, or until all moisture is removed. Additional drying methods such as infrared, microwave power, laser, or other methods can also be utilized to dry the fabric. In such cases, the drying time and temperature may be below or above the above mentioned ranges; however, it is preferable that the temperature does not exceed a range that may result in a loss of fabric strength.

The cleaning process removes the sizing chemistry from the fabric and prepares the fabric for the finishing process, described below.

Finishing Process

The oxidation of the fabric during the cleaning process forms functional hydroxyl groups on the surface of the carbon fiber fabric. These hydroxyl groups ready the carbon fiber fabric to receive an organic copolymer that may be attached through the use of a silane coupling agent. At this point, the appropriate functional group(s) may be added based on the desired end-use composite. These functional groups (such as epoxy, amino, and/or vinyl, for example), are selected based on compatibility with the desired matrix resin. For example, if the desired polymer composite is an epoxy thermosetting resin, then an epoxy group would be the preferred functional group to attach to the fabric during the finishing process. An organic copolymer may be attached through the use of a silane coupling agent, whereby the silane bonds with the hydroxyl group on the carbon fiber fabric surface, leaving the organic functional group available for bonding to a polymer resin. The organic functional group of this finishing step is customizable and specifically chosen dependent upon the end-use composite.

Silane coupling agents are frequently used to bond a polymer resin to a fabric substrate. U.S. application Ser. No. 14/610,458, incorporated herein by reference, discusses this method in detail. The silane coupling agent has two functional groups, an organic substituent capable of bonding with an organic substrate, and an inorganic hydrolyzable substituent capable of bonding with an inorganic substrate. The silanes of the reactive type can serve as coupling agents between the carbon fibers and the matrix resin. The reactive silanes commonly contain a silicone head(s) and a tail(s) containing a functional group or groups that can react with the polymer resin. These groups include primary, secondary, or tertiary amines, vinyl, styryl, alkynyl, methacryloyl, acryloxy, epoxy, thio, sulphide, ureido, isocyanate, oxime, ester, aldehyde, and hydroxy moieties in either unprotected or protected form. The silicone head can be substituted with groups such as ethoxy, methoxy, methyldimethoxy, methydiethoxy, isopropoxy, acetoxy, etc. When the oxidized carbon fiber fabric is treated with an aqueous solution containing a silane coupling agent, hydrolysis of the labile groups occurs, resulting in silane oligomers bonding with the fabric substrate. A final drying process results in a covalent linkage between the fabric and the silane, simultaneously leaving the organic radical of the silane free for bonding to a compatible organic substrate.

In a preferred example, the fabric may be passed through a bath with a solution containing the organic polymer. The polymer may be present in an aqueous solution of about 1-25% by volume of polymer to water. A surfactant may also be added, preferably at about 0.01-0.5% by volume. After being dipped, sprayed, or rolled in a bath containing the solution, the fabric is removed and squeezed to remove any excess solution. This process can be performed at room temperature and may be repeated preferably 3-4 times for at least 2-3 minutes. As in the cleaning process, the dip and squeeze process may be performed stationary, such as in a jig, or may be a continuous process, such as in a range; other suitable processes may be used as well. After the fabric has undergone a dip and squeeze process, the fabric undergoes the same drying process whereby the fabric is dried preferably at 200-315 degrees F. This drying may be performed in a convection oven for anywhere from 30 seconds to 5 minutes, or until all moisture is removed. Additional drying methods such as infrared, microwave power, laser, or other methods can also be utilized to dry the fabric. In such cases, the drying time and temperature may be below or above the above mentioned ranges; however, it is preferable that the temperature does not exceed a range resulting in a loss of fabric strength.

In one embodiment of the present invention, the resulting product is a resin-free carbon fiber fabric finished with specific functional groups attached, ready to receive a particular polymer resin. This process allows for the manufacturing of a finished carbon fiber fabric that may be sold to a customer, whereby the customer may then add the appropriate resin desired for the end-use product. Additionally, and perhaps most importantly, this process provides a carbon fiber fabric with improved and superior ability to bond to a polymer resin, without interference resulting from an inadequate fiber sizing chemistry. In this way, a customizable finished fabric may be manufactured. In an alternative embodiment, the process may continue through to the addition of a polymer resin, resulting in a completed composite product.

Although the present invention is described above in specific terms, values, and ranges, it is to be known that suitable substitutes may be made without departing from the spirit and scope of the invention. One skilled in the art is capable of knowing, for example, which functional groups are compatible for specific end use resins, which silane coupling agents would be appropriate in combination, and what types of substitutions may be appropriate or suitable.

What is claimed is:

1. A process for finishing carbon fiber fabric comprising the steps of:

providing a fabric made from carbon fibers;

removing fiber sizing from said fabric by applying a solution to said fabric, said solution comprising an enzymatic cleanser and an oxidizing agent, whereby said enzymatic cleanser comprises cellulase, lipase, and phosphated alcohol surfactant;

forming hydroxyl groups on the surface of said fabric, whereby said fabric is prepared to receive a functional group;

determining a polymer resin to be used in a final composite;

selecting a functional group based on said polymer resin of said final composite;

attaching said functional group to said fabric whereby said fabric is prepared to receive said polymer resin.

2. The process of claim 1, further including the step of applying a polymer resin coating to said fabric.

3. The process of claim 1, whereby said cellulose and lipase are present in a range of about 0.1 to 10% by volume, and said phosphated alcohol surfactant is present in a range of about 0.05 to 5% by volume.

4. The process of claim 1, whereby said oxidizing agent is hydrogen peroxide.

5. The process of claim 1, whereby the ratio range of said oxidizing agent to said enzymatic cleanser is about 2:1 to 5:2.

6. The process of claim 1, whereby said oxidizing agent and said enzymatic cleanser are mixed in an aqueous solution and present in a concentration range of about 2-15% by volume.

7. The process of claim 1, whereby silane coupling agent is used to attach said functional group.

8. The process of claim 7, whereby said silane coupling agent is an epoxysilane.

9. A process for finishing carbon fiber fabric comprising the steps of:

providing a fabric made from carbon fibers;

removing the carbon fiber sizing by applying a solution to said fabric, said solution comprising hydrogen peroxide in a ratio range of about 2:1 to 5:2 with an enzymatic cleanser comprising cellulase, lipase, and phosphated alcohol surfactant;

forming hydroxyl groups on the surface of said fabric whereby said fabric is prepared to receive an organic functional group;

determining a polymer resin to be used in a final carbon fiber composite;

selecting an organic functional group based on said polymer resin of said final carbon fiber composite;

selecting an organofunctional silane based on said organic functional group;

attaching said organic functional group to said fabric via said silane, whereby said fabric is prepared to receive said polymer resin.

10. The process of claim 9, whereby said cellulose and lipase are present in a range of about 0.1 to 10% by volume, and said phosphated alcohol surfactant is present in a range of about 0.05 to 5% by volume.

11. The process of claim 9, further including the step of applying a polymer resin coating to said fabric.

* * * * *